US010704549B2

(12) United States Patent
Yuki et al.

(10) Patent No.: US 10,704,549 B2
(45) Date of Patent: Jul. 7, 2020

(54) SCREW COMPRESSOR HAVING A DISCHARGING PASSAGE WITH ENLARGED CROSS SECTION AREA

(71) Applicant: Hitachi Industrial Equipment Systems Co., Ltd., Tokyo (JP)

(72) Inventors: Makoto Yuki, Tokyo (JP); Masahiko Takano, Tokyo (JP); Hitoshi Nishimura, Tokyo (JP); Kosuke Sadakata, Tokyo (JP); Toshikazu Harashima, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 331 days.

(21) Appl. No.: 15/558,401

(22) PCT Filed: Mar. 31, 2015

(86) PCT No.: PCT/JP2015/060232
§ 371 (c)(1),
(2) Date: Sep. 14, 2017

(87) PCT Pub. No.: WO2016/157445
PCT Pub. Date: Oct. 6, 2016

(65) Prior Publication Data

US 2018/0058452 A1 Mar. 1, 2018

(51) Int. Cl.
*F04C 18/16* (2006.01)
*F04C 18/08* (2006.01)
(Continued)

(52) U.S. Cl.
CPC ..... *F04C 18/16* (2013.01); *F04C 29/12* (2013.01); *F04C 2240/20* (2013.01); *F04C 2240/30* (2013.01); *F04C 2250/102* (2013.01)

(58) Field of Classification Search
CPC ..... F04C 18/16; F04C 29/12; F04C 18/165; F04C 18/086; F04C 29/0035; F04C 2240/30
(Continued)

(56) References Cited

U.S. PATENT DOCUMENTS 4,078,653 A * 3/1978 Suter ..... F01C 21/102 198/625
5,199,858 A * 4/1993 Tsuboi ..... F04B 39/04 417/362
(Continued)

FOREIGN PATENT DOCUMENTS

DE 44 03 648 A1 8/1995
JP 60-21583 U 2/1985
(Continued)

OTHER PUBLICATIONS

International Preliminary Report on Patentability (PCT/IB/338 & PCT/IB/373) issued in PCT Application No. PCT/JP2015/060232 dated Oct. 12, 2017, including English translation of document C2 (Japanese-language Written Opinion (PCT/ISA/237)) previously filed on Sep. 14, 2017 (Seven (7) pages).
(Continued)

*Primary Examiner* — Deming Wan
(74) *Attorney, Agent, or Firm* — Crowell & Moring LLP

(57) ABSTRACT

A screw compressor includes: a male rotor 2 and a female rotor 3 including a rotor tooth section 21, 31 that has multiple helical teeth, the male rotor 2 and the female rotor 3 rotating in engagement with each other; a casing 4 including a main casing 41 with a bore 45 formed to accommodate the male rotor 2 and the female rotor 3, and a discharge-side casing 43 closing a discharge side of the bore 45; and a discharge passage 60 including a discharge port 61 that opens in a rotational axis direction of the male rotor 2 and the female rotor 3 on a bore side surface of the
(Continued)

discharge-side casing 43, compressed gas flowing from the discharge port 61 circulating in the discharge passage 60. The male rotor 2 and the female rotor 3 are configured such that a discharge-side end surface 21*a*, 31*a* of the rotor tooth section 21, 31 serves as a discharge-side distal end of the male rotor 2 or the female rotor 3 in the rotational axis direction. The discharge passage 60 includes an enlarged flow passage section 63 formed such that the enlarged flow passage section 63 extends from the discharge port 61 in the rotational axis direction of the male rotor 2 and the female rotor 3 and that a flow passage cross-sectional area is gradually enlarged from the discharge port 61 to a downstream side in a compressed gas flow direction.

8 Claims, 10 Drawing Sheets

(51) Int. Cl.
*F04C 29/00* (2006.01)
*F04C 29/12* (2006.01)

(58) Field of Classification Search
USPC ..... 418/201.1
See application file for complete search history.

(56) References Cited

U.S. PATENT DOCUMENTS

| | | | | |
|---|---|---|---|---|
| 5,599,176 | A * | 2/1997 | Reinersmann | F01C 21/02 417/410.4 |
| 5,653,585 | A | 8/1997 | Fresco | |
| 6,692,243 | B1 | 2/2004 | Rousseau | |
| 2001/0048881 | A1 | 12/2001 | Aramaki | |
| 2006/0165543 | A1 | 7/2006 | Fox et al. | |
| 2010/0135839 | A1 * | 6/2010 | Fraser | F04C 18/086 418/197 |
| 2011/0016895 | A1 * | 1/2011 | Sishtla | F04C 29/0007 62/115 |

FOREIGN PATENT DOCUMENTS

| | | | |
|---|---|---|---|
| JP | 60-28291 | U | 2/1985 |
| JP | 63-115587 | U | 7/1988 |
| JP | 7-279868 | A | 10/1995 |
| JP | 8-4675 | A | 1/1996 |
| JP | 8-303372 | A | 11/1996 |
| JP | 2001-336489 | A | 12/2001 |
| JP | 2005-537421 | A | 12/2005 |
| JP | 2011-69309 | A | 4/2011 |
| WO | WO 2013/175817 | A1 | 11/2013 |

OTHER PUBLICATIONS

International Search Report (PCT/ISA/210) issued in PCT Application No. PCT/JP2015/060232 dated Jun. 23, 2015 with English-language translation (six (6) pages).

Japanese-language Written Opinion (PCT/ISA/237) issued in PCT Application No. PCT/JP2015/060232 dated Jun. 23, 2015 (four (4) pages).

English translation of Chinese-language Office Action issued in counterpart Chinese Application No. 201580077768.1 dated Jul. 26, 2018 (seven (7) pages).

* cited by examiner

SCREW COMPRESSOR HAVING A DISCHARGING PASSAGE WITH ENLARGED CROSS SECTION AREA

TECHNICAL FIELD

The present invention relates to a screw compressor and more specifically relates to a screw compressor with a discharge passage for discharging compressed gas.

BACKGROUND ART

A screw compressor includes a male rotor and a female rotor rotating in engagement with each other and a casing that accommodates the male rotor and the female rotor. Generally, the male rotor and the female rotor each include shaft sections on two sides thereof and the shaft sections on the two sides are rotatably supported by bearings held in the casing.

Differently from the screw compressor of this structure, there is known a screw compressor configured such that holes are provided in end surfaces of two sides of each of a male rotor and a female rotor and bearings are held in these holes (refer to, for example, Patent Document 1). The screw compressor described in Patent Document 1 has a structure such that a suction-side bearing casing and a discharge-side bearing casing that constitute a part of a casing include support journals entering holes in which the male rotor and the female rotor are held, and that those support journals support the male rotor and the female rotor.

PRIOR ART DOCUMENT

Patent Document

Patent Document 1: JP-07-279868-A

SUMMARY OF THE INVENTION

Problems to be Solved by the Invention

Meanwhile, the screw compressor generally discharges compressed gas to a downstream side device via one discharge passage provided on a discharge side of the casing. The discharge passage includes a discharge port (compressed gas inlet port of the discharge passage) that opens to the male rotor side and the female rotor side on the discharge side of the casing. A performance of the compressor possibly degrades in the discharge passage since a pressure loss occurs during circulation of the compressed gas. Particularly if the screw compressor is an oil-supply screw compressor, a large quantity of oil is contained in the compressed gas and the pressure loss in the discharge passage is, therefore, prone to increase due to presence of the oil. Owing to this, it is necessary to reduce the pressure loss in the discharge passage.

In the general screw compressor of the structure such that the shaft sections on the two sides of each of the male rotor and the female rotor are supported by the bearings, the bearings attached to the discharge-side shaft sections occupy a certain region in the vicinity of a discharge port. Owing to this, it is necessary to curve or bend the discharge passage in such a manner as to bypass the discharge-side bearings from the discharge port. In the discharge passage having a curved shape or the like, vortexes are prone to be generated due to separation of a flow of the compressed gas, so that there may be a possibility that it is difficult to reduce the pressure loss of the compressed gas.

Furthermore, Patent Document 1 does not describe the discharge passage and not disclose a technique for reducing the pressure loss in the discharge passage. Similarly to the general screw compressor described above, the screw compressor structured to hold the bearings in the holes on the end surfaces of the two sides of each of the male rotor and the female rotor as described in Patent Document 1 is assumed to discharge compressed gas to the downstream side device via one discharge passage. In this case, it is necessary to form the discharge passage into a curved shape or the like in a direction from the discharge port to the downstream side device, depending on an arrangement relationship between the screw compressor and the downstream side device. For example, if the screw compressor is an oil-supply screw compressor, the compressed gas is often swirled to cause the compressed gas to flow into an oil separator in order to improve an oil separation function in the oil separator. In this case, the discharge passage is often formed into the curved shape or the like from the discharge port to the oil separator downward or circumferentially. Owing to this, the problem of the pressure loss in the discharge passage possibly occurs similarly to the case of the general screw compressor described above.

The present invention has been achieved to solve the above-described problems and an object of the present invention is to provide a screw compressor capable of suppressing a pressure loss in a discharge passage.

Means for Solving the Problems

To solve the problems, the present invention adopts, for example, a configuration according to claims.

While the present application includes a plurality of means for solving the above problems, the following is one example. A screw compressor includes: a male rotor and a female rotor each including a rotor tooth section that has a plurality of helical teeth, the male rotor and the female rotor rotating in engagement with each other; a casing including a main casing having a bore formed in such a manner as to accommodate the male rotor and the female rotor, and a discharge-side casing closing a discharge side of the bore; and a discharge passage including a discharge port that opens in a rotational axis direction of the male rotor and the female rotor on a surface of the discharge-side casing close to the bore, compressed gas flowing from the discharge port circulating in the discharge passage. The male rotor and the female rotor are each configured such that a discharge-side end surface of the rotor tooth section serves as a discharge-side distal end of the male rotor or the female rotor in the rotational axis direction. The discharge passage includes an enlarged flow passage section formed such that the enlarged flow passage section extends from the discharge port in the rotational axis direction of the male rotor and the female rotor and that a flow passage cross-sectional area of the enlarged flow passage section is gradually enlarged from the discharge port to a downstream side in a compressed gas flow direction.

Advantages of the Invention

According to the present invention, the discharge passage is configured such that the discharge passage extends from the discharge port in the rotational axis direction of the male rotor and the female rotor and that a flow passage cross-sectional area thereof is gradually enlarged from the discharge port to a downstream side in a compressed gas flow direction. Therefore, it is possible to suppress the pressure loss in the discharge passage.

Objects other than the abovementioned object, configurations, and advantages will be readily apparent from the description of embodiments given below.

MODES FOR CARRYING OUT THE INVENTION

Embodiments of a screw compressor according to the present invention will be described hereinafter with reference to the drawings.

First Embodiment

A configuration of a screw compressor according to a first embodiment will be described first with reference to FIGS. 1 and 2. The present embodiment is an example of applying the present invention to an oil-supply screw compressor.

Figure 1:
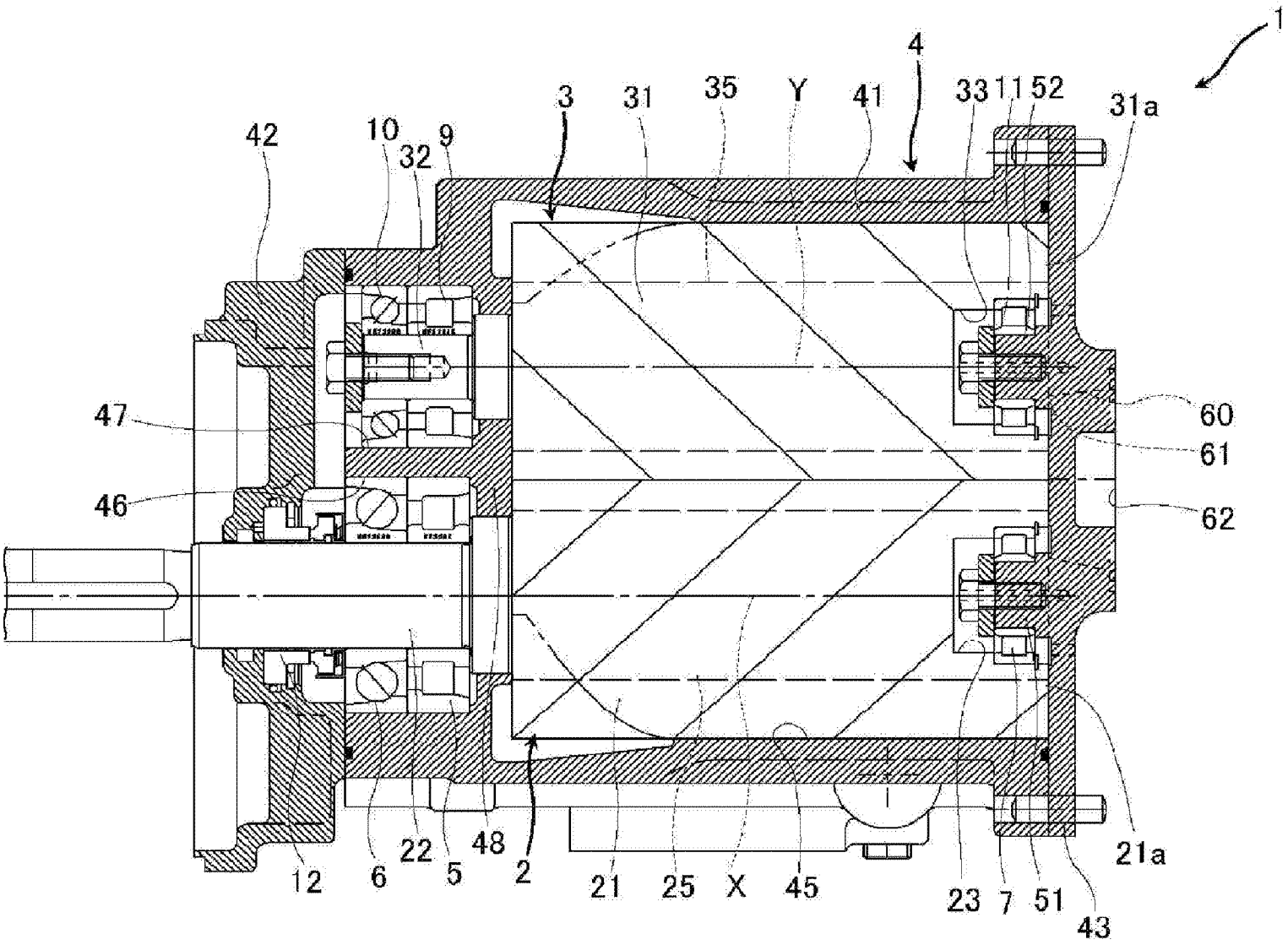
FIG. 1 is a longitudinal sectional view of a screw compressor according to a first embodiment.
Figure 2:
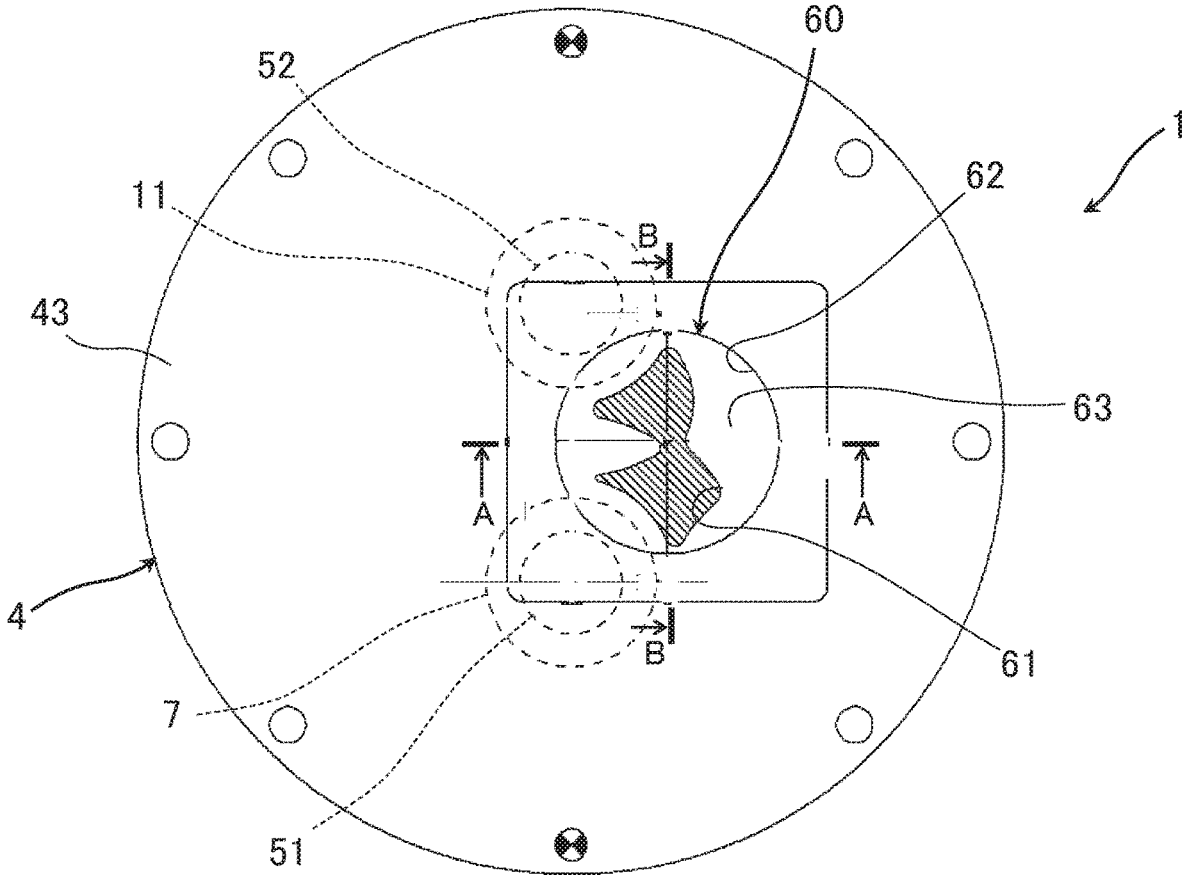
FIG. 2 is a side view of a discharge side of the screw compressor shown in FIG. 1.

FIG. 1 is a longitudinal sectional view of the screw compressor, and FIG. 2 is a side view of a discharge side for illustrating the screw compressor according to the first embodiment shown in FIG. 1. In FIG. 1, a left side is a suction side of the screw compressor and a right side is a discharge side thereof.

In FIG. 1, a screw compressor 1 includes: a male rotor 2 and a female rotor 3 having rotational axes X and Y parallel to each other and rotating in engagement with each other; a casing 4 accommodating the male rotor 2 and the female rotor 3; suction-side bearings (hereinafter, referred to as "MS bearings") 5 and 6 and a discharge-side bearing (hereinafter, referred to as "MD bearing") 7 rotatably supporting the male rotor 2; and suction-side bearings (hereinafter, referred to as "FS bearings") 9 and 10 and a discharge-side bearing (hereinafter, referred to as "FD bearing") 11 rotatably supporting the female rotor 3. The screw compressor 1, together with a rotary drive device (not shown) such as an electric motor that drives the screw compressor 1, an oil separator (not shown), and other devices (not shown), constitutes a compressor unit.

The male rotor 2 is configured with a rotor tooth section 21 having a plurality of helical male teeth and a shaft section 22 formed integrally with a suction side of the rotor tooth section 21. The male rotor 2 has no shaft section in its discharge side and is configured such that a discharge-side end surface 21*a* of the rotor tooth section 21 serves as a discharge-side distal end of the male rotor 2 in a rotational axis direction. A substantially columnar recessed male discharge-side bearing chamber 23 is formed on the discharge-side end surface 21*a* of the rotor tooth section 21 for holding the MD bearing 7. The shaft section 22 extends outward of the casing 4 and is connected to the rotary drive device (not shown). A seal device 12 for sealing leakage of oil to the rotary drive device is installed on the shaft section 22.

The female rotor 3 is configured with a rotor tooth section 31 having a plurality of helical female teeth and a shaft section 32 formed integrally with a suction side of the rotor tooth section 31. The female rotor 3 has no shaft section in its discharge side and is configured such that a discharge-side end surface 31*a* of the rotor tooth section 31 serves as a discharge-side distal end of the female rotor 3 in the rotational axis direction. A substantially columnar recessed female discharge-side bearing chamber 33 is formed on the discharge-side end surface 31*a* of the rotor tooth section 31 for holding the FD bearing 11.

The casing 4 is configured with, for example, a main casing 41 in which the male rotor 2 and the female rotor 3 are arranged, a suction-side casing 42 attached to a suction side (left side in FIG. 1) of the main casing 41, and a discharge-side casing 43 attached to a discharge side (right side in FIG. 1) of the main casing 41.

A bore 45 that is partially overlapping two cylindrical holes is provided in the main casing 41. The male rotor 2 and the female rotor 3 are accommodated in the bore 45 in a state in which the rotor tooth sections 21 and 31 thereof are engaged, and a discharge side of the bore 45 is closed by the discharge-side casing 43. Tooth spaces of the male rotor 2 and the female rotor 3 and an inner wall surface of the main casing 41 surrounding the tooth spaces form a plurality of operating chambers. In a suction-side end portion (left end portion in FIG. 1) of the main casing 41, a male suction-side bearing chamber 46 for holding the MS bearings 5 and 6 that support the male rotor 2 and a female suction-side bearing chamber 47 for holding the FS bearings 9 and 10 that support the female rotor 3 are formed, and these suction-side bearing chambers 46 and 47 are isolated from the bore 45 by a partition section 48. Further, these suction-side bearing chambers 46 and 47 are covered with the suction-side casing 42. A suction passage (not shown) communicating with the bore 45 is formed on a suction side of the main casing 41.

The discharge-side casing 43 includes, on a surface facing the discharge-side end surfaces 21*a* and 31*a* of the male rotor 2 and the female rotor 3, that is, the surface attached to the main casing 41, a protruding male-side journal section 51 fitted into the MD bearing 7 held in the discharge-side bearing chamber 23 of the male rotor 2 and a protruding female-side journal section 52 fitted into the FD bearing 11 held in the discharge-side bearing chamber 33 of the female rotor 3. As shown in FIGS. 1 and 2, a discharge passage 60 communicating with the bore 45 of the main casing 41 is provided in the discharge-side casing 43. A detailed structure of the discharge passage 60 will be described later.

The MS bearings 5 and 6 supporting a suction side of the male rotor 2 are held in the male suction-side bearing chamber 46 of the main casing 41 in a state of being attached to the shaft section 22 of the male rotor 2. On the other hand, the MD bearing 7 supporting a discharge side of the male rotor 2 is held in the discharge-side bearing chamber 23 of the male rotor 2 in a state of being attached to the male-side journal section 51 of the discharge-side casing 43. In other words, the MD bearing 7 is set such that an outer diameter thereof is smaller than a root diameter line 25 of the male rotor 2. The MS bearing 5 and the MD bearing 7 are, for example, cylindrical roller bearings and support radial loads, while the MS bearing 6 is a ball bearing and supports an axial load.

The FS bearings 9 and 10 supporting a suction side of the female rotor 3 are held in the female suction-side bearing chamber 47 of the main casing 41 in a state of being attached to the shaft section 32 of the female rotor 3. On the other hand, the FD bearing 11 supporting a discharge side of the female rotor 3 is held in the discharge-side bearing chamber 33 of the female rotor 3 in a state of being attached to the female-side journal section 52 of the discharge-side casing 43. In other words, the FD bearing 11 is set such that an outer diameter thereof is smaller than a root diameter line 35 of the female rotor 3. The FS bearing 9 and the FD bearing 11 are, for example, cylindrical roller bearings and support radial loads, while the FS bearing 10 is a ball bearing and supports an axial load.

The structure of the discharge passage of the screw compressor 1 according to the first embodiment will next be described with reference to FIGS. 1 to 6B.

Figure 3:
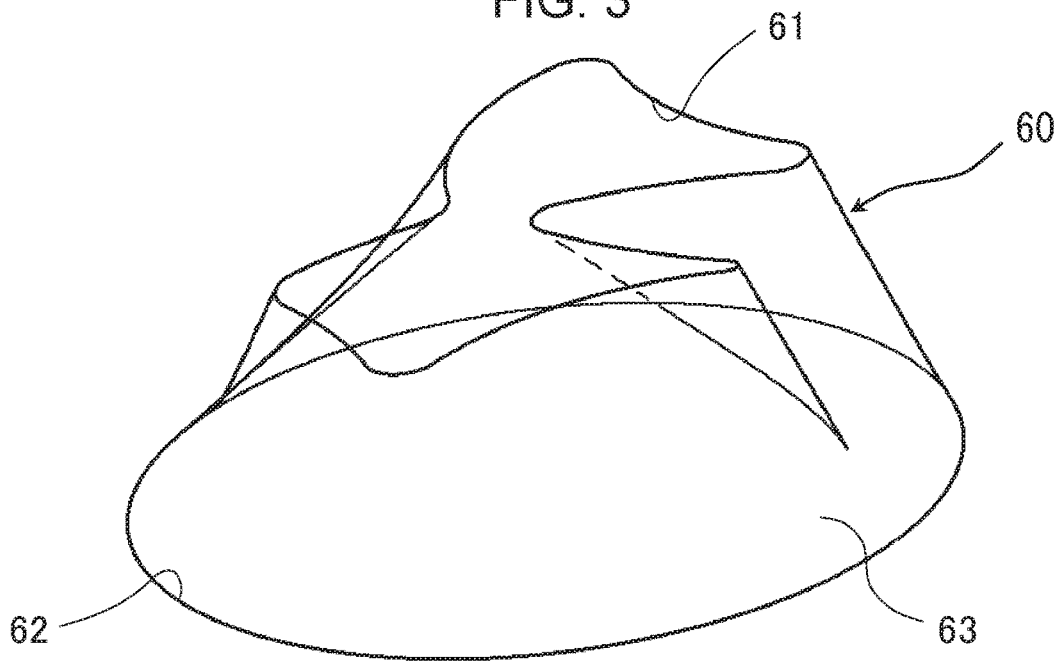
FIG. 3 is a perspective view of an example of a shape of a discharge passage of the screw compressor shown in FIG. 2 in a state in which the shape is viewed from a discharge port side.
Figure 4A:
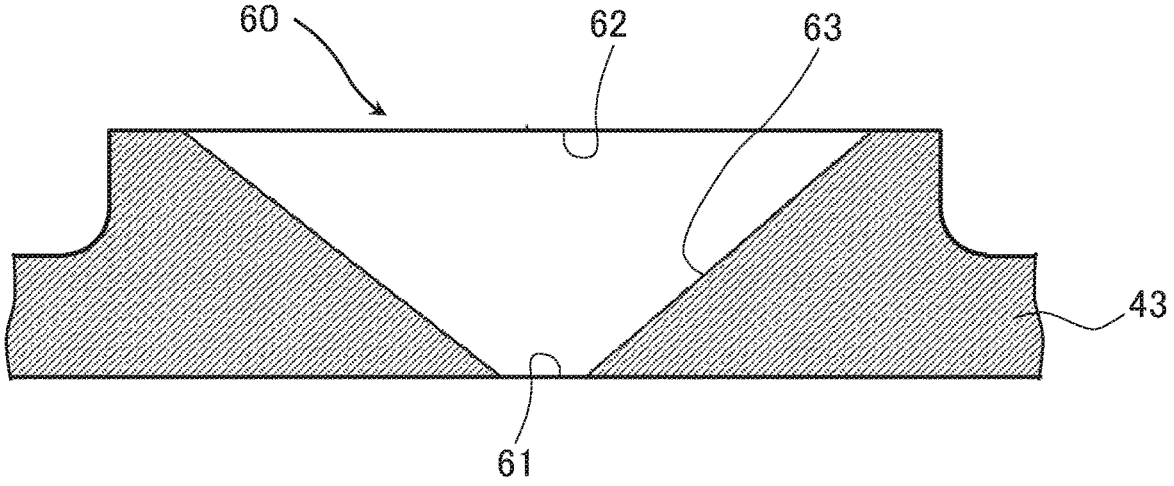
FIG. 4A is a cross-sectional view, taken along A-A, of the discharge passage of the screw compressor shown in FIG. 2.
Figure 4B:
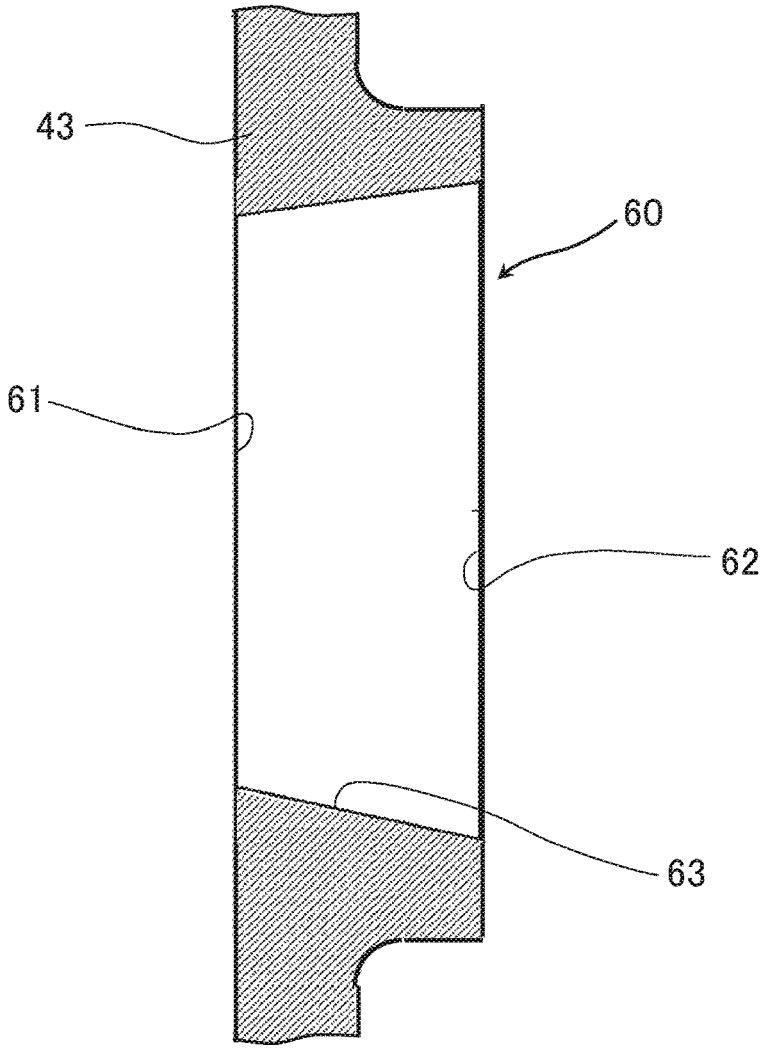
FIG. 4B is a cross-sectional view, taken along B-B, of the discharge passage of the screw compressor shown in FIG. 2.
Figure 5:
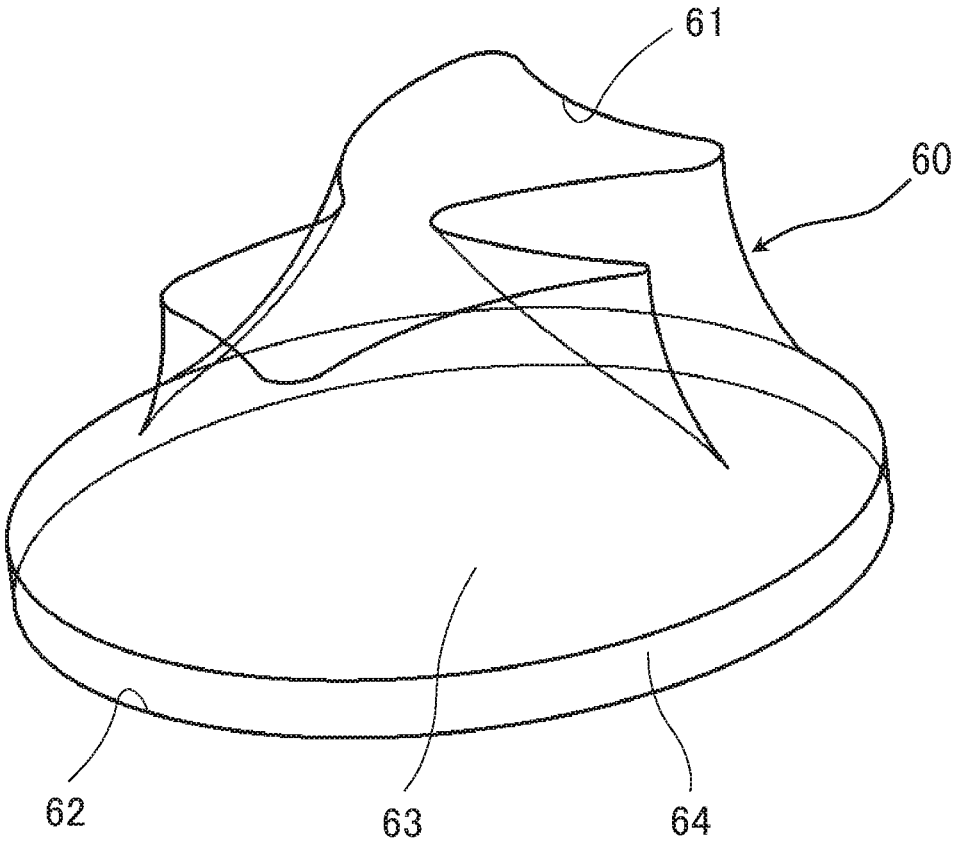
FIG. 5 is a perspective view of another example of the shape of the discharge passage of the screw compressor shown in FIG. 2 in a state in which the shape is viewed from the discharge port side.
Figure 6A:
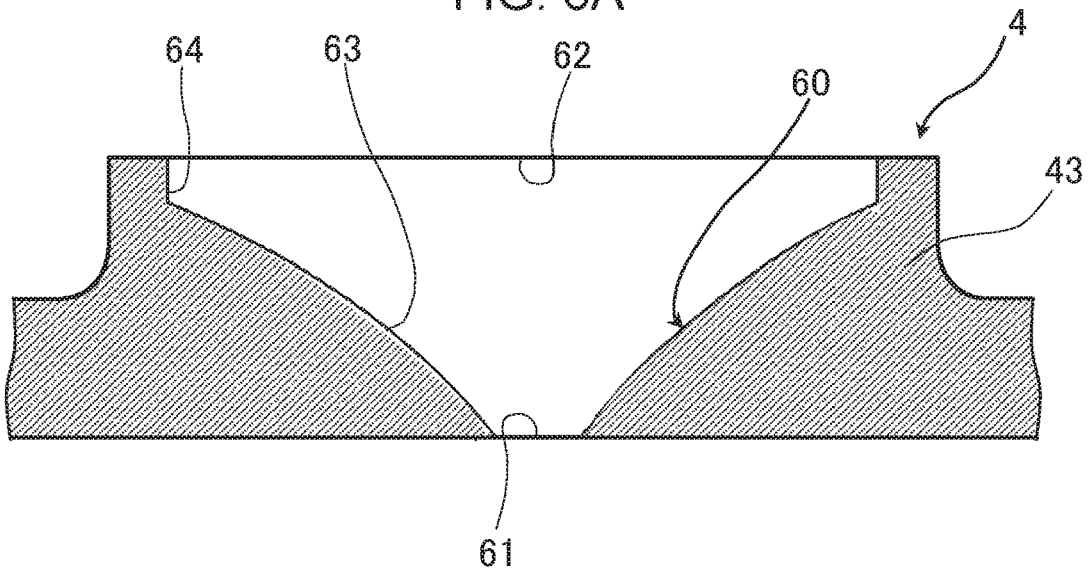
FIG. 6A is a cross-sectional view, taken along A-A, of another example of the discharge passage of the screw compressor shown in FIG. 2.
Figure 6B:
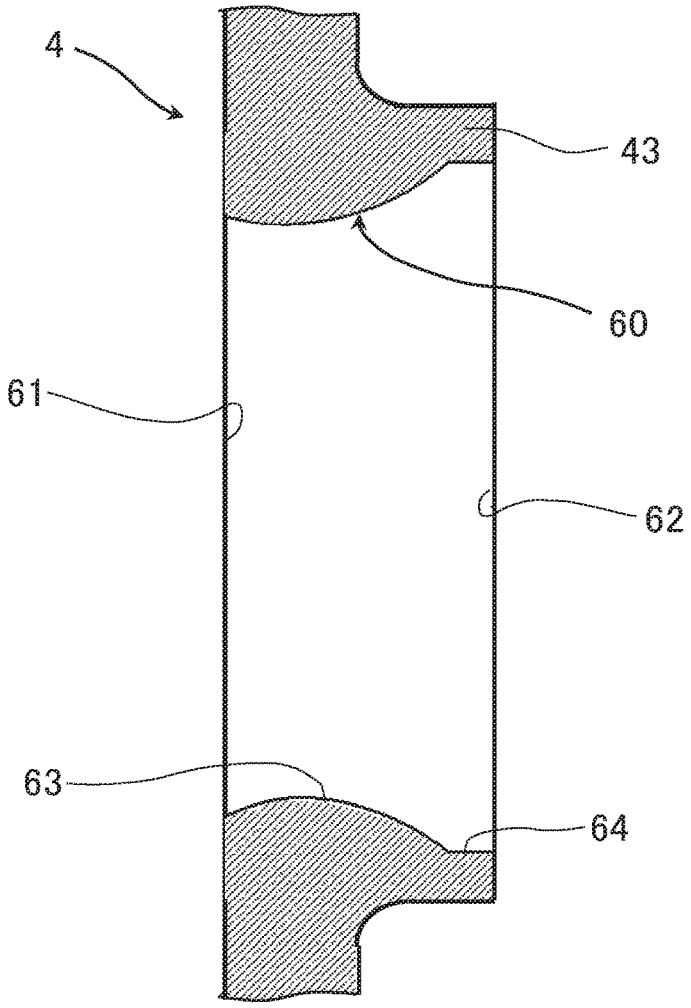
FIG. 6B is a cross-sectional view, taken along B-B, of another example of the discharge passage of the screw compressor shown in FIG. 2.

FIG. 3 is a perspective view of an example of a shape of the discharge passage of the screw compressor 1 shown in FIG. 2 in a state in which the shape is viewed from a discharge port side, FIG. 4A is a cross-sectional view, taken along A-A, of the discharge passage of the screw compressor 1 shown in FIG. 2, FIG. 4B is a cross-sectional view, taken along B-B, of the discharge passage of the screw compressor 1 shown in FIG. 2, FIG. 5 is a perspective view of another example of the shape of the discharge passage of the screw compressor 1 shown in FIG. 2 in a state in which the shape is viewed from the discharge port side, FIG. 6A is a cross-sectional view, taken along A-A, of another example of the discharge passage of the screw compressor 1 shown in FIG. 2, and FIG. 6B is a cross-sectional view, taken along B-B, of another example of the discharge passage of the screw compressor 1 shown in FIG. 2. In FIGS. 3 to 6B, constituent elements denoted by the same reference characters as those shown in FIGS. 1 and 2 are the same constituent elements and are not described in detail.

As shown in FIGS. 1 to 3, the discharge passage 60 includes a discharge port 61 that opens in the rotational axis direction of the male rotor 2 and the female rotor 3 on a bore 45-side surface of the discharge-side casing 43, and a discharge opening 62 that opens in the rotational axis direction on an outer surface of the discharge-side casing 43. The discharge passage 60 is a passage where compressed air flows from the discharge port 61 to circulate, and flows out to a downstream side constituent device of the compressor unit via the discharge opening 62. In other words, the discharge port 61 is a compressed gas inlet port of the discharge passage 60. On the other hand, the discharge opening 62 is a compressed gas outlet port, in the discharge-side casing 43, of the discharge passage 60. A shape of the discharge port 61 is set in response to a tooth shape, a compression ratio, and the like of each of the male rotor 2 and the female rotor 3. A shape of the discharge opening 62 is set to, for example, a substantially circular shape. The discharge passage 60 is configured with an enlarged flow passage section 63 formed, for example, to extend from the discharge port 61 in the rotational axis direction of the male rotor 2 and the female rotor 3 and formed such that a flow passage cross-sectional area is gradually enlarged from the discharge port 61 to the discharge opening 62 (downstream side in a compressed gas flow direction). A longitudinal sectional shape of the discharge passage 60 is set to, for example, be linearly enlarged as shown in FIGS. 4A and 4B.

Alternatively, as shown in FIG. 5, the discharge passage 60 can be configured with the enlarged flow passage section 63 formed, for example, to extend from the discharge port 61 in the rotational axis direction of the male rotor 2 and the female rotor 3 and formed such that the flow passage cross-sectional area is gradually enlarged from the discharge port 61 to the downstream side, and a linear flow passage section 64 having a flow passage cross-sectional area that is substantially constant from the enlarged flow passage section 63 to the discharge opening 62. As shown in FIGS. 6A and 6B, a longitudinal sectional shape of the enlarged flow passage section 63 is set to be enlarged into a curved shape having an R. In other words, the shape of the discharge passage 60 may be such that the discharge passage 60 extends from the discharge port 61 in the rotational axis direction of the male rotor 2 and the female rotor 3 and the flow passage cross-sectional area thereof is smoothly enlarged to make it difficult to generate vortexes due to separation of the flow of the compressed gas.

Operation of the screw compressor according to the first embodiment will next be described with reference to FIGS. 1 and 2.

In FIG. 1, the male rotor 2 driven by the rotary drive device (not shown) drives the female rotor 3 to rotate. The plurality of operating chambers formed by the tooth spaces of the male rotor 2 and the female rotor 3 and the inner wall surface of the casing 4 surrounding the tooth spaces increase their volumes to suck gas via a suction passage (not shown), and then reduce their volumes to compress the gas while moving axially in response to rotation of the male rotor 2 and the female rotor 3. The compressed gas that reaches the discharge-side end surfaces 21*a* and 31*a* of the male rotor 2 and the female rotor 3 flows from the discharge port 61 shown in FIGS. 1 and 2 into the discharge passage 60, passes through the discharge opening 62 of the discharge-side casing 43, and is discharged to the other constituent devices of the compressor unit.

Effects of the screw compressor according to the first embodiment will next be described with reference to FIGS. 1 and 7 to 10 while being compared with those in a case of the general screw compressor configured such that the shaft sections on the two sides of each rotor are supported by the bearings.

Figure 7:
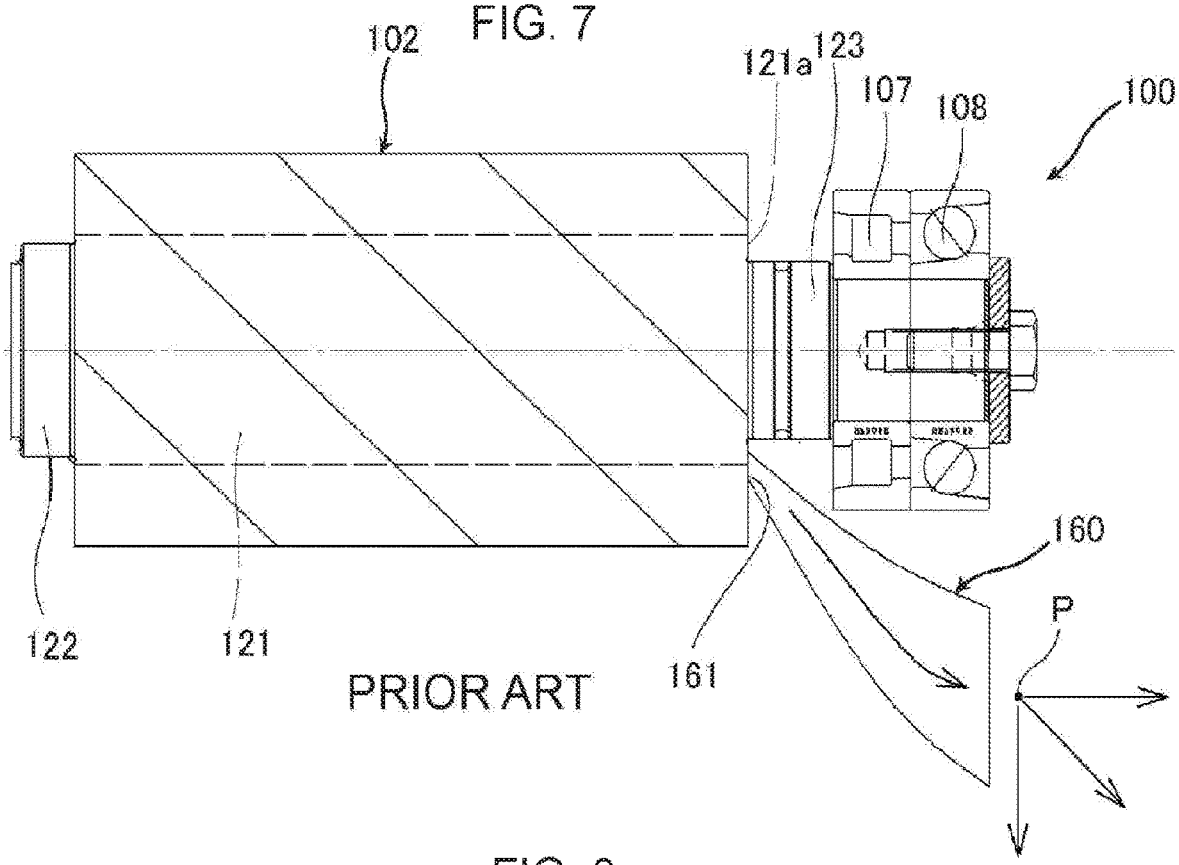
FIG. 7 is an explanatory diagram illustrating a direction in which a discharge passage can be formed in an general screw compressor configured such that shaft sections on two sides of a rotor are supported by bearings.
Figure 8:
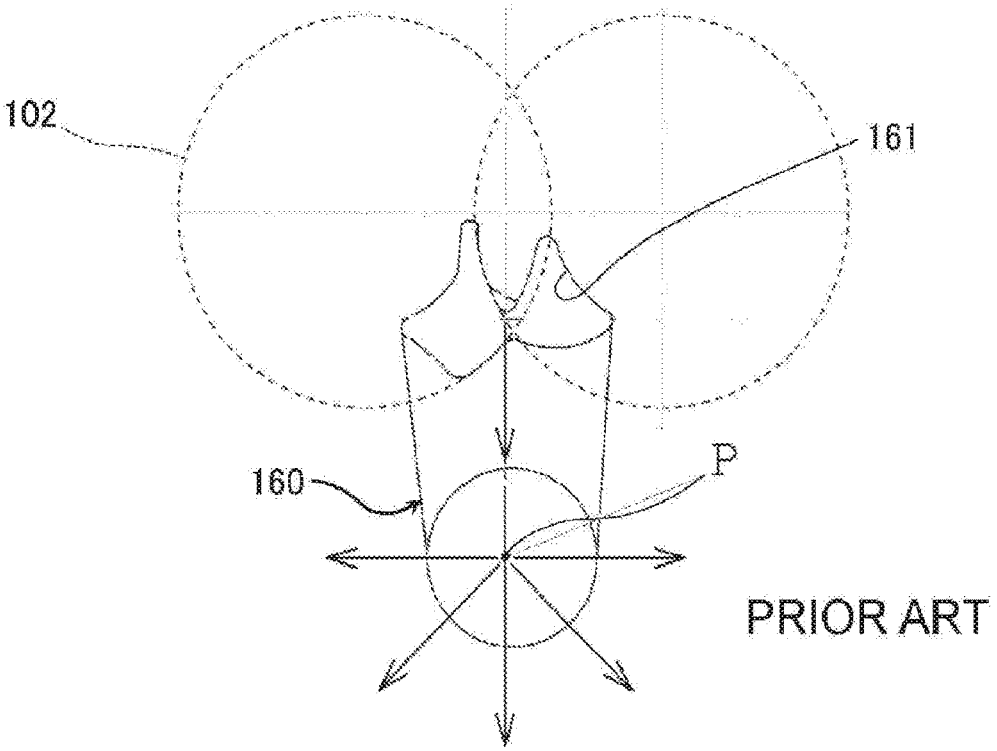
FIG. 8 is an explanatory diagram of the direction in which the discharge passage can be formed as shown in FIG. 7 in a state in which the direction is viewed from discharge sides of rotors in a rotational axis direction.
Figure 9:
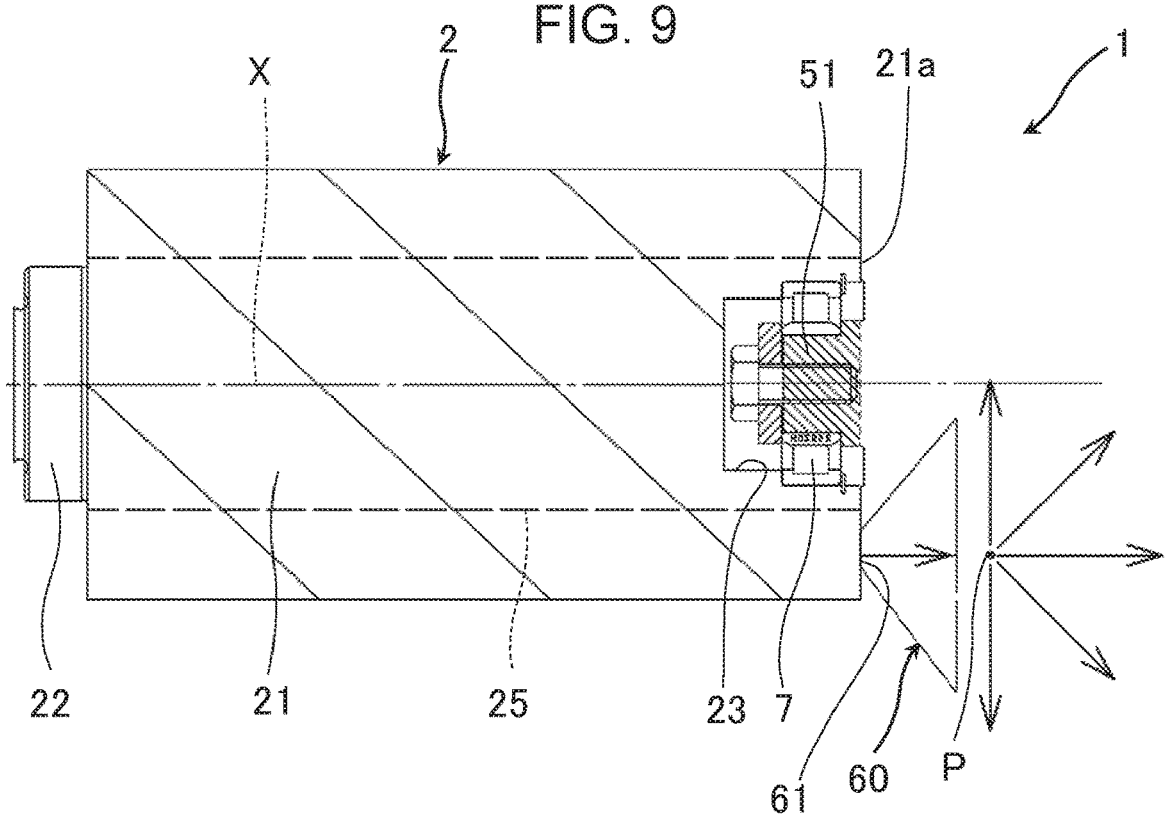
FIG. 9 is an explanatory diagram illustrating a direction in which a discharge passage can be formed in the screw compressor according to the first embodiment.
Figure 10:
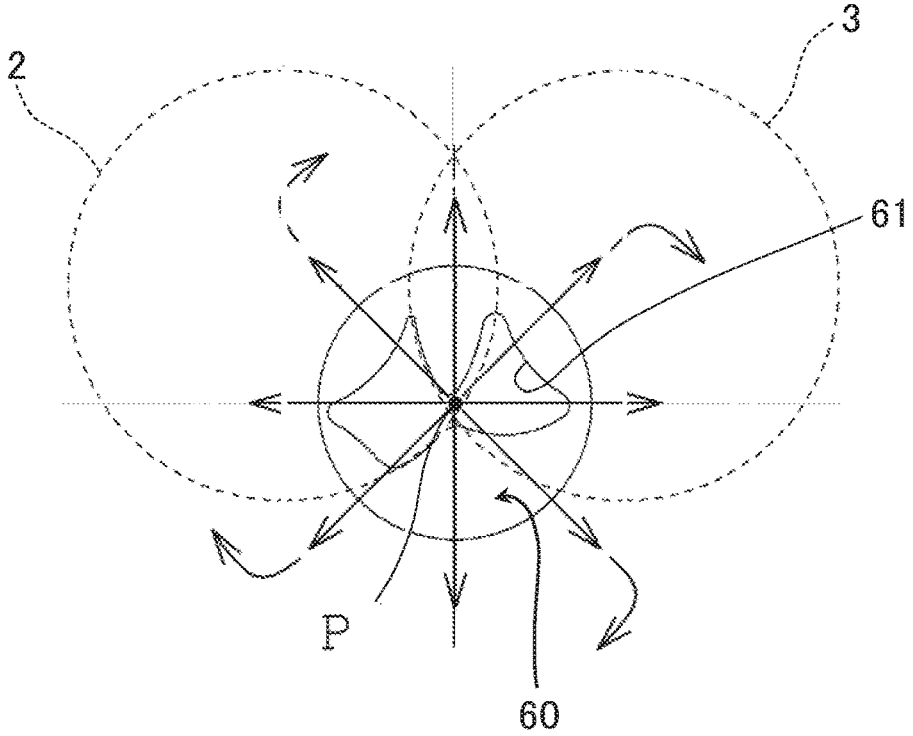
FIG. 10 is an explanatory diagram of the direction in which the discharge passage can be formed as shown in FIG. 9 in a state in which the direction is viewed from discharge sides of rotors in a rotational axis direction.

FIG. 7 is an explanatory diagram illustrating a direction in which the discharge passage can be formed in the general screw compressor configured such that the shaft sections on the two sides of each rotor are supported by bearings, FIG. 8 is an explanatory diagram of the direction in which the discharge passage can be formed as shown in FIG. 7 in a state in which the direction is viewed from a discharge side of the rotor in a rotational axis direction, FIG. 9 is an explanatory diagram illustrating a direction in which the discharge passage can be formed in the screw compressor 1 according to the first embodiment, and FIG. 10 is an explanatory diagram of the direction in which the discharge passage can be formed as shown in FIG. 9 in a state in which the direction is viewed from the discharge sides of the rotors in the rotational axis direction according to the first embodiment. In FIGS. 7 to 10, constituent elements denoted by the same reference characters as those shown in FIGS. 1 to 6B are the same constituent elements and are not described in detail.

As shown in FIG. 7, a screw compressor 100 according to a comparative example includes a rotor 102 configured with a rotor tooth section 121 having a plurality of teeth and shaft sections 122 and 123 provided on two sides of the rotor tooth section 121, and the shaft sections 122 and 123 of the rotor 102 are supported by bearings. In this case, bearings 107 and 108 attached to the discharge-side shaft section 123 occupy a certain region in the vicinity of an outside of a discharge-side end surface 121*a* of the rotor tooth section 121 in the rotational axis direction. Owing to this, as shown in FIGS. 7 and 8, it is necessary to curve a discharge passage 160, including a discharge port 161 that opens in the rotational axis direction, from the discharge port 161 in a direction (downward direction in FIGS. 7 and 8) of bypassing the discharge-side bearings 107 and 108. In the curved discharge passage 160, it is difficult to reduce a pressure loss of the compressed gas due to generation of vortexes resulting from the separation of a flow of the compressed gas. Particularly if the screw compressor is an oil-supply screw compressor, the compressed gas containing a large quantity of oil circulates in the discharge passage and a large pressure loss is possibly generated by the large quantity of oil. In other words, the curved discharge passage 160 has a great influence on a performance of the screw compressor.

Furthermore, a formation direction of the discharge passage 160 after a point P of the discharge passage 160 that bypasses the discharge-side bearings 107 and 108 is limited to arrow directions (a downward direction, an obliquely downward direction, an obliquely left lower direction, an obliquely lower right direction, the rotational axis direction, a left direction, and a right direction) shown in FIGS. 7 and 8 due to the presence of the bearings 107 and 108. Owing to this, there is a possibility that arrangement of the compressor 100 and other devices of the compressor unit is restricted and it is difficult to downsize the compressor unit.

In the present embodiment, by contrast, as shown in FIG. 1, the MD bearing 7 and the FD bearing 11 are held in the male discharge-side bearing chamber 23 and the female discharge-side bearing chamber 33 provided on the discharge-side end surfaces 21*a* and 31*a* of the male rotor 2 and the female rotor 3, respectively, and the male-side journal section 51 and the female-side journal section 52 of the discharge-side casing 43 are fitted into the MD bearing 7 and the FD bearing 11 held in those discharge-side bearing chambers 23 and 33, thereby supporting the discharge sides of the male rotor 2 and the female rotor 3. In other words, there are no shaft sections on the discharge sides of the male rotor 2 and the female rotor 3, and the discharge-side end surfaces 21*a* and 31*a* of the rotor tooth sections 21 and 31 serve as the discharge-side distal ends of the male rotor 2 and the female rotor 3 in the rotational axis direction. Moreover, the MD bearing 7 and the FD bearing 11 are arranged in the rotor tooth sections 21 and 31, respectively. Owing to this, as shown in FIG. 9, the formation direction of the discharge passage 60 including the discharge port 61 that opens in the rotational axis direction of the male rotor 2 and the female rotor 3 (not shown in FIG. 9) is not restricted by the presence of the discharge-side shaft section, the MD bearing 7, and the FD bearing 11 (not shown in FIG. 9).

Thus, according to the present embodiment, the discharge passage 60 is configured such that the discharge passage 60 extends from the discharge port 61 in the rotational axis direction of the male rotor 2 and the female rotor 3 and the flow passage cross-sectional area thereof is gradually enlarged from the discharge port 61 to the discharge opening 62 (downstream side in the compressed gas flow direction). While vortexes are prone to be generated by the separation of the flow of the gas if the diffuser-shaped passage the flow passage cross-sectional area of which is enlarged is curved, the discharge passage 60 extending in the rotational axis direction can suppress the generation of vortexes. As a result, the pressure loss of the compressed gas can be reduced, compared with the curved discharge passage. Further, enlarging the flow passage cross-sectional area of the discharge passage 60 can reduce a flow velocity of the compressed gas that passes through the discharge passage 60. As a result, the pressure loss of the compressed gas due to friction with the discharge passage 60 is reduced.

Furthermore, as shown in FIGS. 9 and 10, the formation direction of the discharge passage 60 having the enlarged flow passage cross-sectional area after the point P is not required to consider the MD bearing 7 and the FD bearing 11 and is, therefore, arbitrary. Owing to this, a degree of freedom for the arrangement of the screw compressor 1 and the other constituent devices of the compressor unit improves. Moreover, even if the discharge passage 60 after the point P needs to be curved in response to the arrangement of the constituent devices of the compressor unit, the flow velocity is already reduced in a curved section and the pressure loss in the discharge passage 60 can be, therefore, suppressed regardless of the arrangement of the constituent devices.

Furthermore, since there is no need to consider the MD bearing 7 and the FD bearing 11 in relation to the shape of the discharge passage 60 after the point P, the discharge passage 60 can be configured to be branched into a plurality of sections outward as indicated by a plurality of arrows show in FIG. 10. In this case, since the flow velocity of the compressed gas is already reduced in the branch sections, it is possible to suppress the pressure loss in the plurality of branch sections. In addition, since the plurality of branch sections can be configured to spread outward, it is possible to further enlarge flow passage cross-sectional areas of the branch sections. In this case, the flow velocity is further reduced in the branch sections, so that it is possible to further suppress the pressure loss in the branch sections.

In this way, according to the present embodiment, it is possible to select the shape and the direction of the discharge passage 60 without giving consideration to the MD bearing 7 and the FD bearing 11. In other words, a degree of freedom for the selection of the flow passage direction of the discharge passage 60 and that for the selection of the number of branches of the passage improve. It is thereby possible to suppress the pressure loss in the discharge passage 60.

As described above, according to the first embodiment, the discharge passage 60 is configured such that the discharge passage 60 extends from the discharge port 61 in the rotational axis direction of the male rotor 2 and the female rotor 3 and that the flow passage cross-sectional area thereof is gradually enlarged from the discharge port 61 to the downstream side in the compressed gas flow direction. Therefore, it is possible to suppress the pressure loss in the discharge passage 60.

Moreover, according to the present embodiment, the suction sides of the male rotor 2 and the female rotor 3 are supported by the MS bearings 5 and 6 and the FS bearings 9 and 10 attached to the shaft sections 22 and 32, and the discharge sides thereof are supported by the MD bearing 7 and the FD bearing 11 that are held in the discharge-side bearing chambers 23 and 33 provided on the discharge-side end surfaces 21*a* and 31*a* of the rotor tooth sections 21 and 31. Therefore, it is possible to suppress the pressure loss in the discharge passage 60 while the male rotor 2 and the female rotor 3 are stably supported.

Second Embodiment

A second embodiment of a screw compressor to which the present invention is applied will next be exemplarily described with reference to FIGS. 11 and 12.

Figure 11:
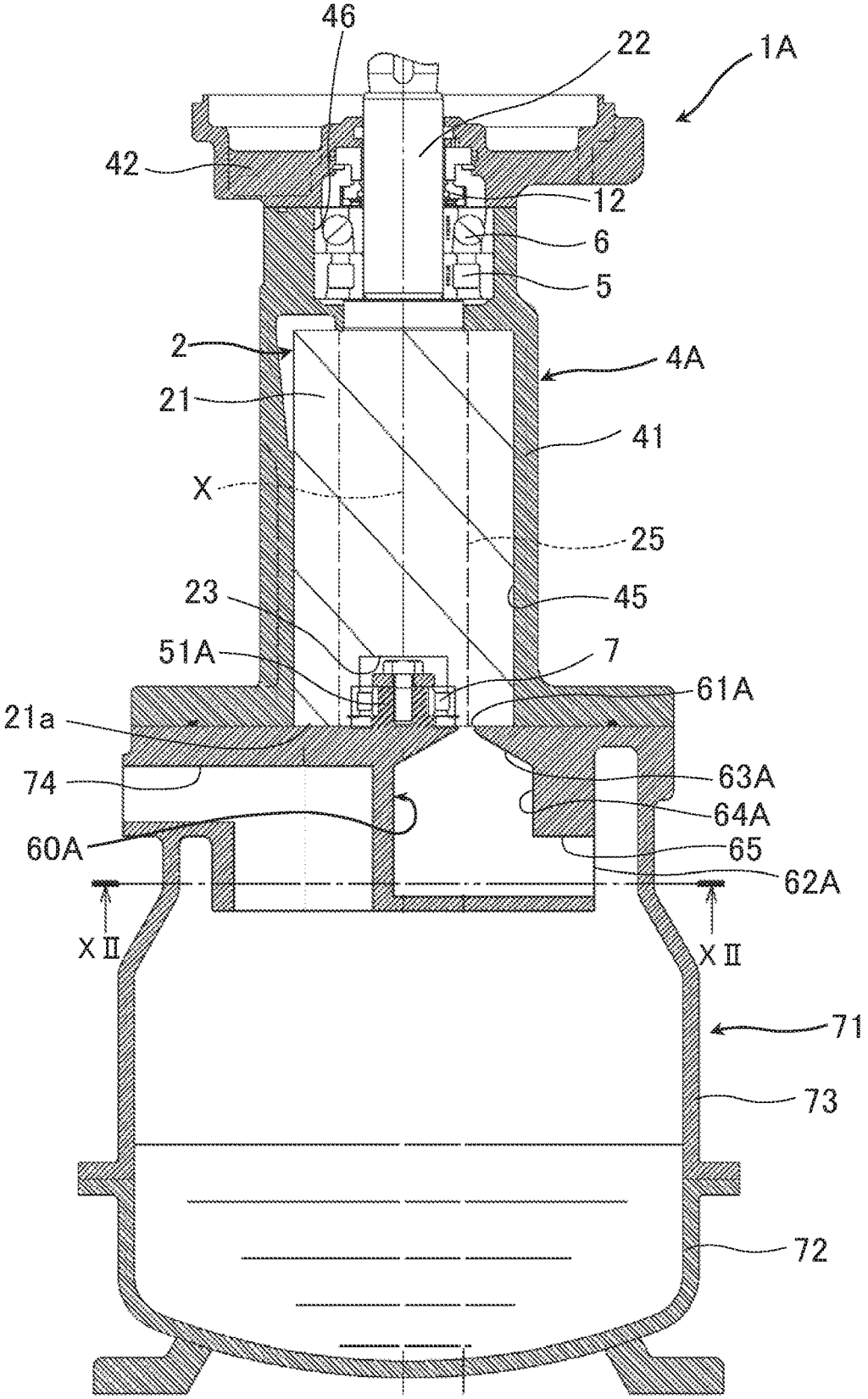
FIG. 11 is a longitudinal sectional view of a screw compressor according to a second embodiment together with an oil separator.
Figure 12:
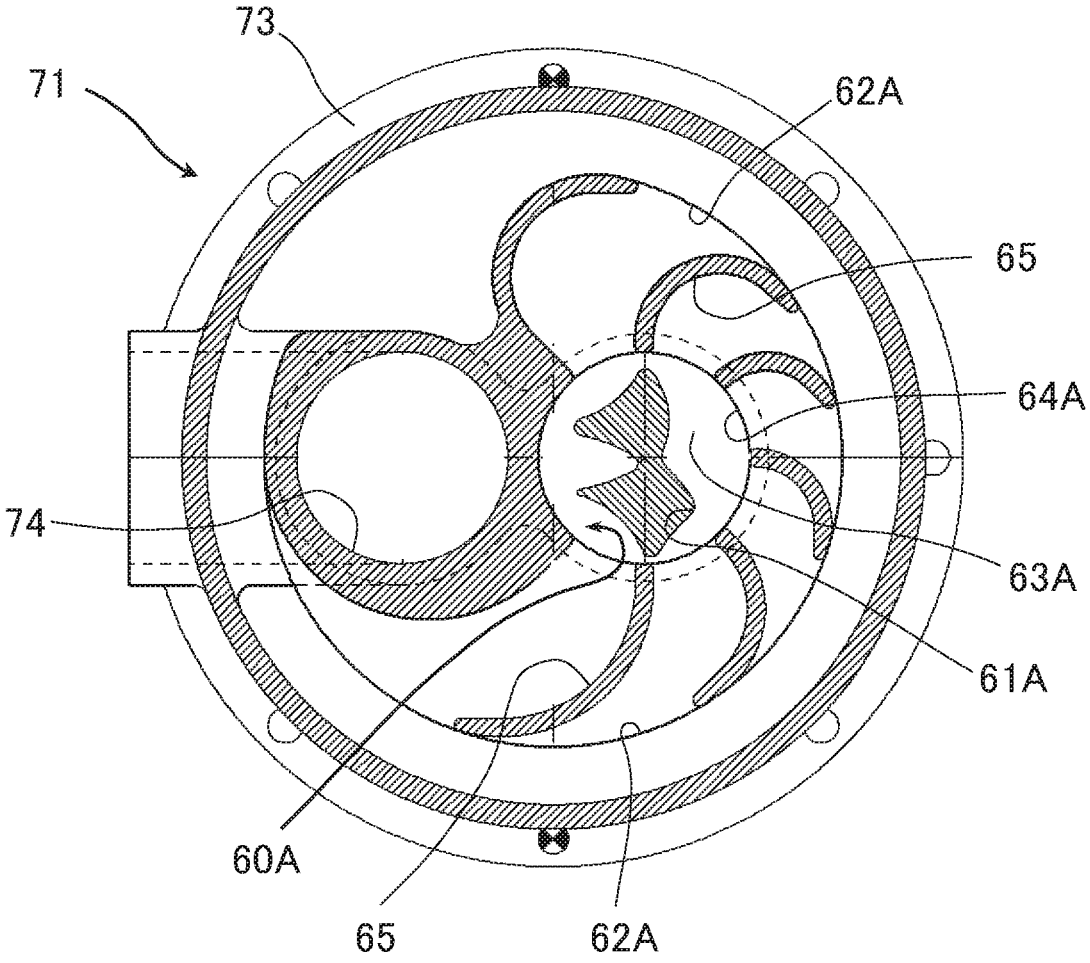
FIG. 12 is a cross-sectional view, taken along XII-XII, of the screw compressor shown in FIG. 11.

FIGS. 11 and 12 illustrate a screw compressor 1A according to the second embodiment. FIG. 11 is a longitudinal sectional view of the second embodiment together with an oil separator, and FIG. 12 is a cross-sectional view, taken along XII-XII, of the screw compressor 1A shown in FIG. 11. In FIGS. 11 and 12, constituent elements denoted by the same reference characters as those shown in FIGS. 1 to 10 are the same constituent elements and are not described in detail.

The screw compressor 1A shown in FIGS. 11 and 12 is a form that embodies a branch structure of the discharge passage 60 discussed in the first embodiment. Furthermore, while the screw compressor 1 is configured to be independent of the other constituent devices (not shown) of the compressor unit in the first embodiment, a part of the screw compressor 1A is configured integrally with a part of an oil separator 71 that is one of the constituent devices of the compressor unit in the second embodiment.

Specifically, the screw compressor 1A is installed vertically in such a manner that the rotational axes X and Y are oriented in a vertical direction, a suction side is an upper side, and a discharge side is a lower side. The oil separator 71 that separates oil from compressed gas discharged from the screw compressor 1A is arranged below the screw compressor 1A. The oil separator 71 is configured with a lower casing 72 that stores the oil separated from the compressed gas, and an upper casing 73 that is connected to an upper end of the lower casing 72 and that functions to separate the oil contained in the compressed gas. The discharge side (lower side in FIG. 11) of the main casing 41 of the screw compressor 1A is attached to an upper end portion of the upper casing 73, and the discharge side of the bore 45 of the main casing 41 is closed by the upper casing 73.

As shown in FIG. 11, the upper casing 73 includes, on a surface to which the main casing 41 is attached, a protruding male-side journal section 51A fitted into the MD bearing 7 held in the discharge-side bearing chamber 23 of the male rotor 2 and a protruding female-side journal section (not shown) fitted into the FD bearing 11 (not shown in FIG. 11) held in the discharge-side bearing chamber 33 (not shown in FIG. 11) of the female rotor 3 (not shown in FIG. 11). That is, the upper casing 73 also functions as a discharge-side casing of the screw compressor 1A. In other words, it may be said that the discharge-side casing of the screw compressor 1A constitutes a part of the upper casing 73.

As shown in FIGS. 11 and 12, a discharge passage 60A communicating with the bore 45 of the main casing 41 is provided in an upper portion of the upper casing 73. The discharge passage 60A includes a discharge port 61A that opens in the rotational axis direction (vertical direction in FIG. 11, direction perpendicular to a sheet of FIG. 12) of the male rotor 2 and the female rotor 3 on a main-casing-41-side surface of the upper casing 73. A shape of the discharge port 61A is similar to that of the discharge port 61 in the first embodiment.

The discharge passage 60A is configured with an enlarged flow passage section 63A configured such that that the enlarged flow passage section 63A extends from the discharge port 61A in the rotational axis direction (downward direction in FIG. 11, vertically upward direction with respect to the sheet of FIG. 12) of the male rotor 2 and the female rotor 3 and that a flow passage cross-sectional area thereof is gradually enlarged from the discharge port 61A to the downward direction (downstream side in the compressed gas flow direction), a linear flow passage section 64A having a flow passage cross-sectional area that is substantially constant from the enlarged flow passage section 63A to the downward direction, and a plurality of (six in FIG. 12) branch flow passage sections 65 branched from the linear flow passage section 64A in a horizontal direction (direction orthogonal to a direction in which the linear flow passage section 64A extends). A shape of the enlarged flow passage section 63A is similar to that of the enlarged flow passage section 63 in the first embodiment. The branch flow passage sections 65 are formed into a spiral shape spreading outward from an outer peripheral side of the linear flow passage section 64A, and flow passage cross-sectional areas thereof are gradually enlarged outward from the linear flow passage section 64A. An outlet of each of the branch flow passage sections 65 constitutes a discharge opening 62A of the discharge passage 60A, and a plurality of discharge openings 62A are, therefore, present.

Moreover, a passage 74 that guides the compressed gas from which the oil is separated to the constituent devices of the compressor unit disposed on the downstream side of the oil separator 71 is formed on a left-hand side of the discharge passage 60A in the upper portion of the upper casing 73.

Functions and effects of the screw compressor 1A will next be described with reference to FIGS. 11 and 12.

In FIGS. 11 and 12, the gas compressed by the screw compressor 1A and containing a large quantity of oil flows from the discharge port 61A of the discharge passage 60A formed in the upper casing 73 of the oil separator 71 into the enlarged flow passage section 63A and the flow velocity of the gas is reduced. Subsequently, the compressed gas with the reduced flow velocity flows into the plurality of branch flow passage sections 65 branched from the linear flow passage section 64A and spread outward in a swirling manner. The compressed gas circulating in the branch flow passage sections 65 is discharged from the plurality of discharge openings 62A into the oil separator 71 in such a manner as to spread outward, and flows down while swirling within the oil separator 71. At this time, the oil is centrifugally separated from the gas by a difference in specific gravity between air and oil. The separated oil flows down along an inner wall of the oil separator 71 and is stored in the lower casing 72 of the oil separator 71. On the other hand, the compressed gas from which the oil is separated is fed to the downstream side constituent devices of the compressor unit via the passage 74.

In the present embodiment, similarly to the first embodiment, the discharge passage 60A includes the enlarged flow passage section 63A that extends from the discharge port 61A in the rotational axis direction of the male rotor 2 and the female rotor 3 and the flow passage cross-sectional area of which is gradually enlarged from the discharge port 61A to the downstream side in the compressed gas flow direction. Therefore, the generation of the vortexes due to the separation of the flow of the gas is suppressed, and the flow velocity of the compressed gas passing through the discharge passage 60A is reduced. As a result, it is possible to reduce the pressure loss of the compressed gas in the discharge passage 60A.

Furthermore, in the present embodiment, since the discharge passage 60A is branched into the plurality of passages after enlargement of the flow passage cross-sectional area, the compressed fluid diverges after the reduction of the flow velocity. Owing to this, even if the compressed fluid diverges, it is possible to reduce the pressure loss.

Moreover, since the discharge passage 60A is branched into the plurality of passages in the direction of spreading outward, the compressed gas is dispersed from the plurality of discharge openings 62A and flows into the oil separator 71. Owing to this, it is possible to reduce the pressure loss at a time of the flow of the compressed gas into the oil separator 71, compared with a case where the compressed gas flows into the oil separator 71 at a stroke from one discharge opening via one discharge passage.

Furthermore, since the branch flow passage sections 65 of the discharge passage 60A are formed into the spiral shape from the outer periphery of the linear flow passage section 64A, the compressed gas passing through the branch flow passage sections 65 smoothly flows into the oil separator 71 while swirling. It is, therefore, possible to reduce pressure loss at the time of the flow of the compressed gas into the oil separator 71 and to improve an oil separation function by a centrifugal force.

In addition, since the branch flow passage sections 65 are formed such that the flow passage cross-sectional areas are enlarged, it is possible to reduce the flow velocity of the compressed gas passing through the branch flow passage sections 65. It is, therefore, possible to further reduce the pressure loss in the branch flow passage sections 65.

The second embodiment can attain the following effects in addition to the similar effects to those of the first embodiment.

According to the present embodiment, since the screw compressor 1A arranged above the oil separator 71 is vertically installed in such a manner that the discharge side is the lower side, it is possible to shorten the discharge passage 60A, compared with a case where the screw compressor is horizontally installed. As a result, it is possible to achieve a reduction of the pressure loss in the discharge passage 60A by as much as a reduction in a length of the discharge passage 60A.

Furthermore, according to the present embodiment, since the discharge-side casing of the casing 4A of the screw compressor 1A constitutes a part of the upper casing 73 of the oil separator 71, it is possible to shorten the discharge passage 60A, compared with a case where the discharge-side casing of the screw compressor and the upper casing of the oil separator are configured separately. As a result, it is possible to reduce the pressure loss in the discharge passage 60A and reduce the number of components of the compressor unit.

Third Embodiment

A third embodiment of a screw compressor to which the present invention is applied will next be exemplarily described with reference to FIG. 13.

Figure 13:
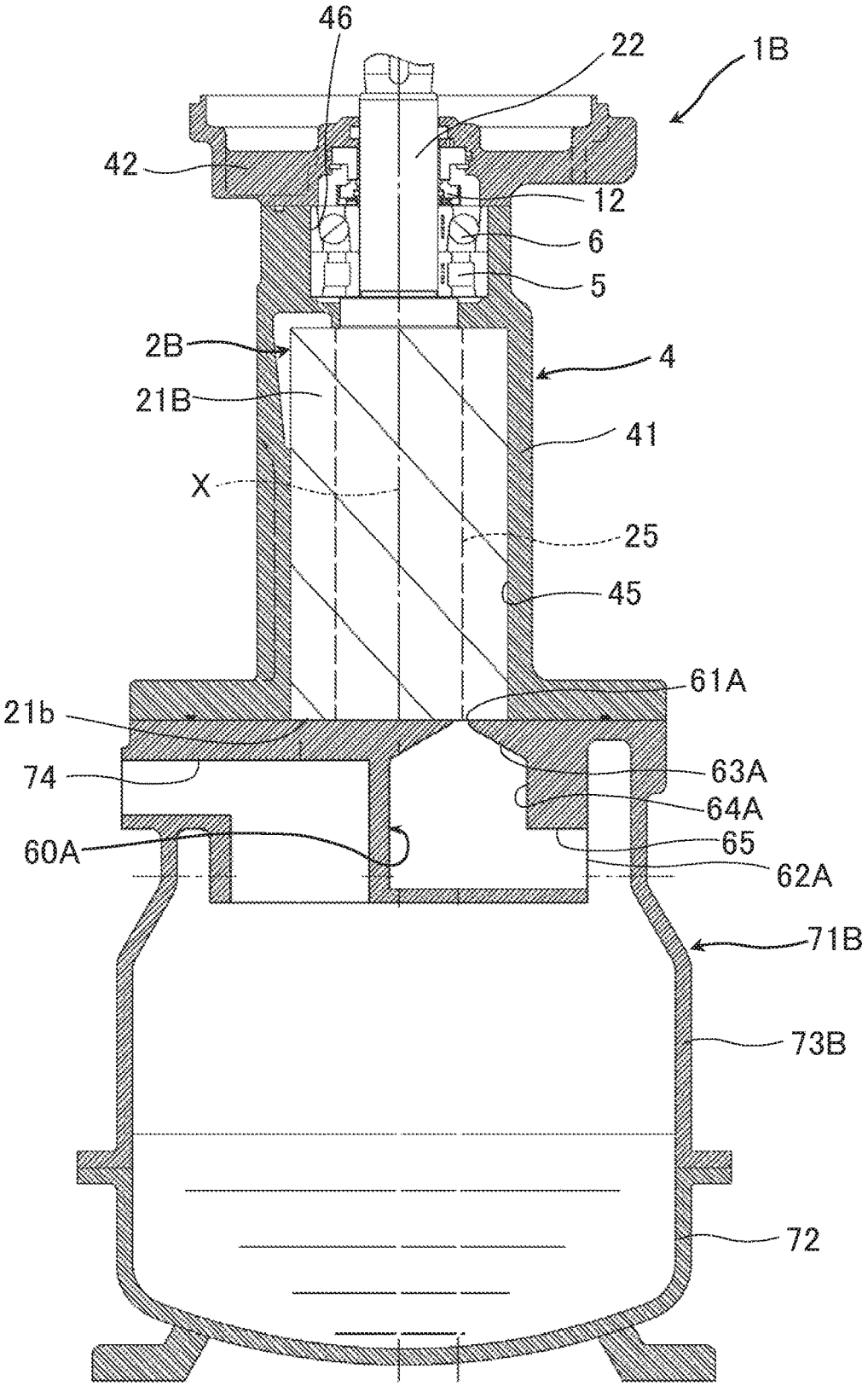
FIG. 13 is a longitudinal sectional view of a screw compressor according to a third embodiment together with an oil separator.

FIG. 13 is a longitudinal sectional view of a screw compressor 1B according to the third embodiment together with an oil separator. In FIG. 13, constituent elements denoted by the same reference characters as those shown in FIGS. 1 to 12 are the same constituent elements and are not described in detail.

The screw compressor 1B shown in FIG. 13 is configured such that suction sides of a male rotor 2B and a female rotor (not shown in FIG. 13) are cantilever-supported using only the MS bearings 5 and 6 and the FS bearings 9 and 10 (not shown in FIG. 13), as opposed to the screw compressor 1A in the second embodiment configured such that suction sides of the male rotor 2 and the female rotor 3 are supported by the MS bearings 5 and 6 and the FS bearings 9 and 10 (not shown in FIG. 11) and discharge sides thereof are supported by the MD bearing 7 and the FD bearing 11 (not shown in FIG. 11). Specifically, the male rotor 2B and the female rotor (not shown) of the screw compressor 1B are configured such that a discharge-side end surface 21*b* of a rotor tooth section 21B is formed into a planar shape and that the discharge-side end surface 21*b* of the rotor tooth section 21B serves as a discharge-side distal end of the male rotor 2B in the rotational axis direction. Further, bearings are not present on the discharge sides of the male rotor 2B and the female rotor. Therefore, a formation direction of the discharge passage 60A including the discharge port 61A that opens in the rotational axis direction of the male rotor 2B and the female rotor is not restricted, similarly to the first and second embodiments.

In the present embodiment, it is unnecessary to provide the discharge-side bearing chambers 23 and 33 of the second embodiment on the discharge-side end surface 21*b* of the male rotor 2B and that of the female rotor. In addition, an upper casing 73B of an oil separator 71B does not need the configuration of the male-side journal section 51A and the female-side journal section (not shown) of the second embodiment.

The third embodiment can attain the following effect in addition to the similar effects to those of the second embodiment.

According to the present embodiment, since only the suction sides of the male rotor 2B and the female rotor are cantilever-supported using the MS bearings 5 and 6 and the FS bearings 9 and 10, it is possible to reduce the number of components and simplify the configuration, compared with the second embodiment, while maintaining suppressing the pressure loss in the discharge passage 60A.

Other Embodiments

While the present invention has been applied to the oil-supply screw compressor in the first to third embodiments described above, the present invention is also applicable to a water-lubricated screw compressor and an oil-free screw compressor.

Furthermore, while an example of the male rotor 2 and the female rotor each having the structure such that the shaft section is provided on the suction side of the rotor tooth section has been illustrated in the first to third embodiments described above, the present invention is also applicable to the male rotor 2 and the female rotor each configured only with the rotor tooth section. In this case, a screw compressor is structured such that suction-side bearing chambers holding the MS bearings 5 and 6 and the FS bearings 9 and 10 (suction-side bearings) are formed on suction-side end surfaces of the rotor tooth sections, and that the suction-side casing 42 includes the male-side journal section 51 fitted into the MS bearings 5 and 6 and the female-side journal section 52 fitted into the FS bearings 9 and 10.

While an example of using the cylindrical roller bearings as the MD bearing 7 and the FD bearing 11 of the male rotor 2 and the female rotor 3 has been described in the first and second embodiments described above, needle bearings can be used as the discharge-side bearings of the male rotor 2 and the female rotor 3. Using the needle bearings having small radial dimensions makes it possible to set smaller diameters of holes of the discharge-side bearing chambers 23 and 33 provided on the discharge-side end surfaces 21*a* and 31*a* of the male rotor 2 and the female rotor 3, compared with the case of using the cylindrical roller bearings. It is also possible to set larger diameters of the male-side journal section 51, 51A and the female-side journal section 52 of the discharge-side casing 43 of the screw compressor 1 or the upper casing 73 of the oil separator 71.

While an example of the casing 4 configured such that the discharge-side casing 43 is attached to the main casing 41 has been illustrated in the first embodiment described above, it is possible to apply a casing such that the main casing 41 and the discharge-side casing 43 are configured integrally.

While an example of configuring the discharge-side casing of the casing 4A integrally with a part of the oil separator 71 has been illustrated in the second embodiment described above, the discharge-side casing of the casing 4A can be configured integrally with a part of the device other than the oil separator 71 of the compressor unit.

While the present invention is applied to the screw compressor with the two screw rotors that the a pair of male and female rotors in the first to third embodiments described above, the present invention is also applicable to a discharge passage of a single-rotor or triple-rotor screw compressor in addition to such a two-rotor screw compressor.

Furthermore, the present invention is not limited to the present embodiments but encompasses various modifications. The abovementioned embodiments have been described in detail for describing the present invention so that the present invention is easy to understand. The present invention is not always limited to the embodiments having all the configurations described so far. For example, the configuration of a certain embodiment can be partially replaced by the configuration of the other embodiment or the configuration of the other embodiment can be added to the configuration of the certain embodiment. Furthermore, for a part of the configuration of each embodiment, addition, deletion, and/or replacement of the other configuration can be made.

DESCRIPTION OF REFERENCE CHARACTERS

1, 1A, 1B: Screw compressor
2, 2B: Male rotor
3: Female rotor
4, 4A: Casing
5, 6: MS bearing (suction-side bearing)
7: MD bearing (discharge-side bearing)
9, 10: FS bearing (suction-side bearing)
11: FD bearing (discharge-side bearing)
21, 21B, 31: Rotor tooth section
23, 33: Delivery-side bearing chamber
41: Main casing
43: Delivery-side casing
45: Bore
51, 51A: Male-side journal section
52: Female-side journal section
60, 60A: Delivery passage
61, 61A: Delivery port
63, 63A: Enlarged flow passage section
65: Branch flow passage section
71: Oil separator (device)
73: Upper casing (discharge-side casing)

The invention claimed is:

1. A screw compressor comprising:

a male rotor and a female rotor each including a rotor tooth section that has a plurality of helical teeth, the male rotor and the female rotor rotating in engagement with each other;

a casing including a main casing having a bore formed in such a manner as to accommodate the male rotor and the female rotor, and a discharge-side casing closing a discharge side of the bore; and a discharge passage including a discharge port that opens from a compressed gas inlet port with a shape set in response to a tooth shape and a compression ratio of the male and female rotors to a compressed gas outlet port with a substantially circular shape in a rotational axis direction of the male rotor and the female rotor on a surface of the discharge-side casing close to the bore, compressed gas flowing from the discharge port circulating in the discharge passage, wherein the male rotor and the female rotor are each configured such that a discharge-side end surface of the rotor tooth section serves as a discharge-side distal end of the male rotor or the female rotor in the rotational axis direction, and the discharge passage includes an enlarged flow passage section formed such that the enlarged flow passage section extends from the discharge port in the rotational axis direction of the male rotor and the female rotor and that a flow passage cross-sectional area of the enlarged flow passage section is gradually enlarged from the discharge port to a downstream side in a compressed gas flow direction.

2. The screw compressor according to claim 1, wherein the discharge passage further includes branch flow passage sections that diverge the compressed gas flowing via the enlarged flow passage section into a plurality of flows.

3. The screw compressor according to claim 2, wherein the branch flow passage sections are branched in such a manner as to spread outward.

4. The screw compressor according to claim 3 wherein each of the branch flow passage sections is formed such that a flow passage cross-sectional area is gradually enlarged outward.

5. The screw compressor according to claim 1, wherein the discharge-side casing is constituted integrally with a part of a device to which the compressed gas is discharged via the discharge passage.

6. The screw compressor according to claim 1, wherein the male rotor and the female rotor are each rotatably supported by a discharge-side bearing and a suction-side bearing, the male rotor and the female rotor each include a recessed discharge-side bearing chamber that is provided on the discharge-side end surface of the rotor tooth section and that holds the discharge-side bearing, and the discharge-side casing includes a male-side journal section fitted into the discharge-side bearing held in the discharge-side bearing chamber of the male rotor, and a female-side journal section fitted into the discharge-side bearing held in the discharge-side bearing chamber of the female rotor.

7. The screw compressor according to claim 1, wherein the male rotor and the female rotor are each rotatably supported only by a suction-side bearing.

8. A screw compressor comprising:

a male rotor and a female rotor each including a rotor tooth section that has a plurality of helical teeth, the male rotor and the female rotor rotating in engagement with each other;

a casing including a main casing having a bore formed in such a manner as to accommodate the male rotor and the female rotor, and a discharge-side casing closing a discharge side of the bore; and a discharge passage including a discharge port that opens in a rotational axis direction of the male rotor and the female rotor on a surface of the discharge-side casing close to the bore, compressed gas flowing from the discharge port circulating in the discharge passage, wherein the male rotor and the female rotor are each configured such that a discharge-side end surface of the rotor tooth section serves as a discharge-side distal end of the male rotor or the female rotor in the rotational axis direction, the discharge passage includes an enlarged flow passage section formed such that the enlarged flow passage section extends from the discharge port in the rotational axis direction of the male rotor and the female rotor and that a flow passage cross-sectional area of the enlarged flow passage section is gradually enlarged from the discharge port to a downstream side in a compressed gas flow direction, the discharge passage further includes branch flow passage sections that diverge the compressed gas flowing via the enlarged flow passage section into a plurality of flows, the branch flow passage sections are branched in such a manner as to spread outward, and the branch flow passage sections are branched in a spiral fashion.

* * * * *